US006079327A

United States Patent [19]

Sarada

[11] Patent Number: 6,079,327

[45] Date of Patent: Jun. 27, 2000

[54] DUAL COLOR NON-IMPACT PRINTING FOR POSTAGE METERS

[75] Inventor: Thyagaraj Sarada, Norwalk, Conn.

[73] Assignee: Pitney Bowes Inc., Stamford, Conn.

[21] Appl. No.: 08/263,368

[22] Filed: Jun. 20, 1994

[51] Int. Cl.[7] ..... B41J 3/50

[52] U.S. Cl. ..... 101/93.11

[58] Field of Search ..... 101/91, 45, 287, 101/93.11, 93.12

[56] References Cited

U.S. PATENT DOCUMENTS

| | | | |
|---|---|---|---|
| 3,869,986 | 3/1975 | Hubbard | 101/91 |
| 4,519,311 | 5/1985 | Lowe | 101/91 |
| 4,580,144 | 4/1986 | Calvi | 346/76 PH |
| 4,673,303 | 6/1987 | Sansone et al. | 101/91 |
| 4,868,757 | 9/1989 | Gil | 364/464.03 |
| 5,073,935 | 12/1991 | Pastor | 380/30 |
| 5,114,478 | 5/1992 | Auslander et al. | 106/20 |
| 5,325,773 | 7/1994 | Manduley | 101/91 |

FOREIGN PATENT DOCUMENTS 2 097 330 11/1982 United Kingdom .

*Primary Examiner*—Ren Yan

*Attorney, Agent, or Firm*—Ronald Reichman; Michael E. Melton

[57] ABSTRACT

A postage meter printer for printing a postage indicia with authentication information. The printer has two printheads. One printhead is supplied with an ink that has the characteristic of being readable by an optical character reader and the second printhead is supplied with a second ink that includes a fluorescent ink. The printer is of a size such that both printheads are able to print in an area prescribed by the postal service as the area to be occupied by a postage indicia.

8 Claims, 2 Drawing Sheets

DUAL COLOR NON-IMPACT PRINTING FOR POSTAGE METERS

BACKGROUND OF THE INVENTION

In the mailing field, there are two requirements for the preparation of a mail piece that is to be posted by the postal service. There must be postage applied to the mail piece and there must be an address to which the mail piece is to be sent. A large portion of first class letter mail received by the postal service for delivery is imprinted with a postage indicia that indicates there has been an accounting for the payment of postage. The postage indicia is printed with a fluorescent ink which allows the postal service to not only assure that the indicia is authentic, but also assists the postal service in orienting mail pieces.

In the area of addressing, the postal service for years has been automating mail delivery processing by reading the address on mail pieces by machine. Initially, the postal service relied on the postnet code, which is a bar code, for the purpose of determining the zip code to which a mail piece is to be sent. This is accomplished with a bar code reader. In a more recent development, the postal service has been using optical character readers for reading the addresses in the address blocks of mail pieces. Clearly, the inks that are used to print addresses and postnet bar codes require high contrast with the background of the mail piece and good resolution in printing the bar codes and alphanumerics.

In the past, the printing of a postage indicia and the printing of an address and other information on a mail piece have been performed by different printing mechanisms. The latter includes the printing of data for evidencing the authenticity of the postage. The inks used for printing the postage indicia are required to be fluorescent; whereas, inks for printing other data had to be machine readable. Because of the different requirements of the inks for printing postage indicia and printing other data on a mail piece, the operations had to be performed separately. Along with the use of the two different printers, the indicia and other data were located on different areas of a mail piece. Clearly, it would be advantageous to provide a single printer that prints both the postage indicia and machine readable data. It also would be advantageous to print postage verification in the indicia block as well as postage information.

SUMMARY OF THE INVENTION

The instant invention is directed to the field of mail production wherein a single printer is capable of printing both the postage indicia and verification information.

With the advent of non-impact printing, printers are now smaller than the prior mechanical printers and are able to print faster. With this development, more opportunities are offered. One opportunity is the ability to print data in a smaller area. With smaller printers and the ability to print in a more confined area, a scheme has to be devised for providing postage verification information to the postal service in a convenient manner. The postal service requires that a postage impression be of a size of approximately 1.5"×3.0" for evidencing the payment of postage. By having this area used for giving postage verification as well as postage imprinting, the postal service would be able to verify whether the postage indicia is a valid one.

The instant invention applies primarily to the use of an ink jet printhead within a postage meter, but other types of non imprint printers such as thermal printers can be used to practice the invention as well. The ink jet printer used in the instant invention has two printheads and two separate chambers that are confluent with the respective printheads. One of the ink chambers contains an ink with a fluorescent dye that can be detected by the postal service and the second chamber contains a high contrast ink, usually black ink, that will yield an imprint readily readable by a bar code reader or optical character reader.

The invention also can be utilized in a postage meter that relies on thermal printing. One half of the thermal ribbon can be inked with a fluorescent ink and the second half can be inked with a high contrast ink. Normally, the upper half of the thermal ribbon will contain fluorescent ink and the lower half will contain high contrast ink. By utilizing the technology of the instant invention, one is capable of printing both the postage indicia and at least postage verification data.

DETAILED DESCRIPTION OF THE PREFERRED EMBODIMENT

Figure 1:
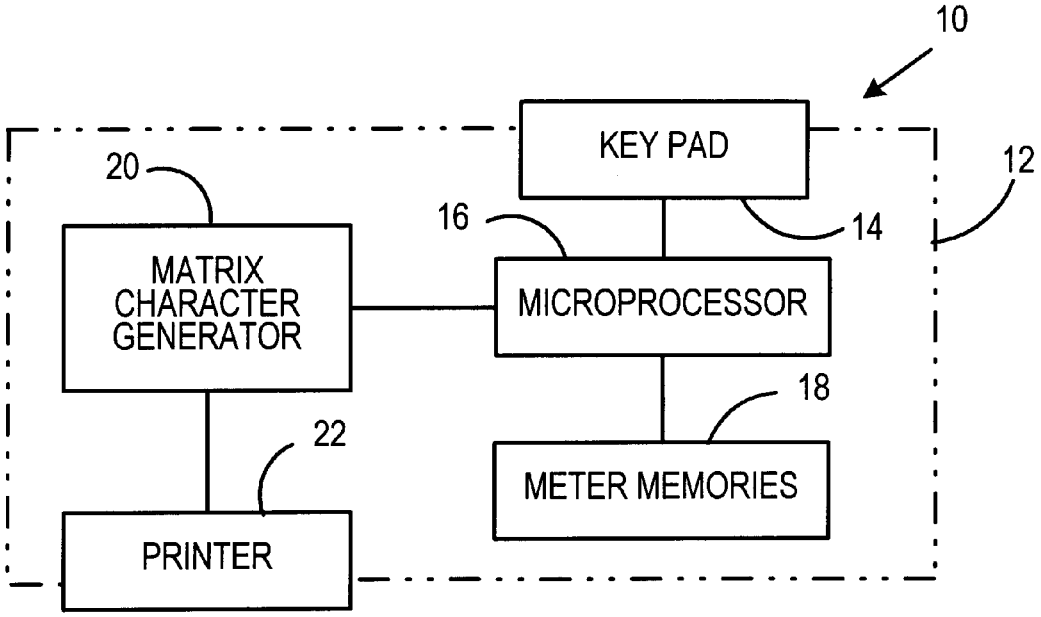
FIG. 1 is a block diagram showing the components of a postage meter in which the instant invention can be practiced.

With reference now to FIG. 1, the components of a postage meter are shown in block diagram form. The postage meter is shown generally at 10, and includes a housing 12 that supports a key pad 14 for inputting data. Such input could include the amount of postage to be printed, the date, accounting data, identity of the mailer and the like. The key pad 14 is connected to a microprocessor 16 which can be any other number of commercially available microprocessors such as an Intel 80C 51. A matrix character generator 20 is connected to the microprocessor 16 and to a non-impact printer 22. For purposes of this invention, the printer 22 can be an ink jet printer or a thermal printer. Connected to the microprocessor 16 is a meter memory unit 18 that contains the ascending and descending registers that allow postage accounting. As is known in the art, the descending register indicates the amount of unused postage that has been purchased from the postal service and the ascending register records the total amount of postage that has been dispensed by the postage meter 10. It will be appreciated that there are many other components of a postage meter, such as connections for the refreshing of postage in the meter memory unit 18, timing sensors, security devices, daters and the like, but since such components do not form part of the instant invention, they will not be described.

In operation, the mail clerk inputs the amount of postage to be applied, the class mail, and other necessary information through the keypad 14. This information is received by the microprocessor 16 that is programmed to command the matrix character generator 20 to control the printer 22 so as to print the postage indicia with appropriate postage data on a mail piece as commanded by the input data. With the input of the postage data, such as amount of postage, date of mailing, postage meter number and mailer identification number, an encrypted number can be derived. In addition, the microprocessor 16 will cause the meter memory unit 18 to account for the amount of postage that is printed by the printer 22.

Figure 2:
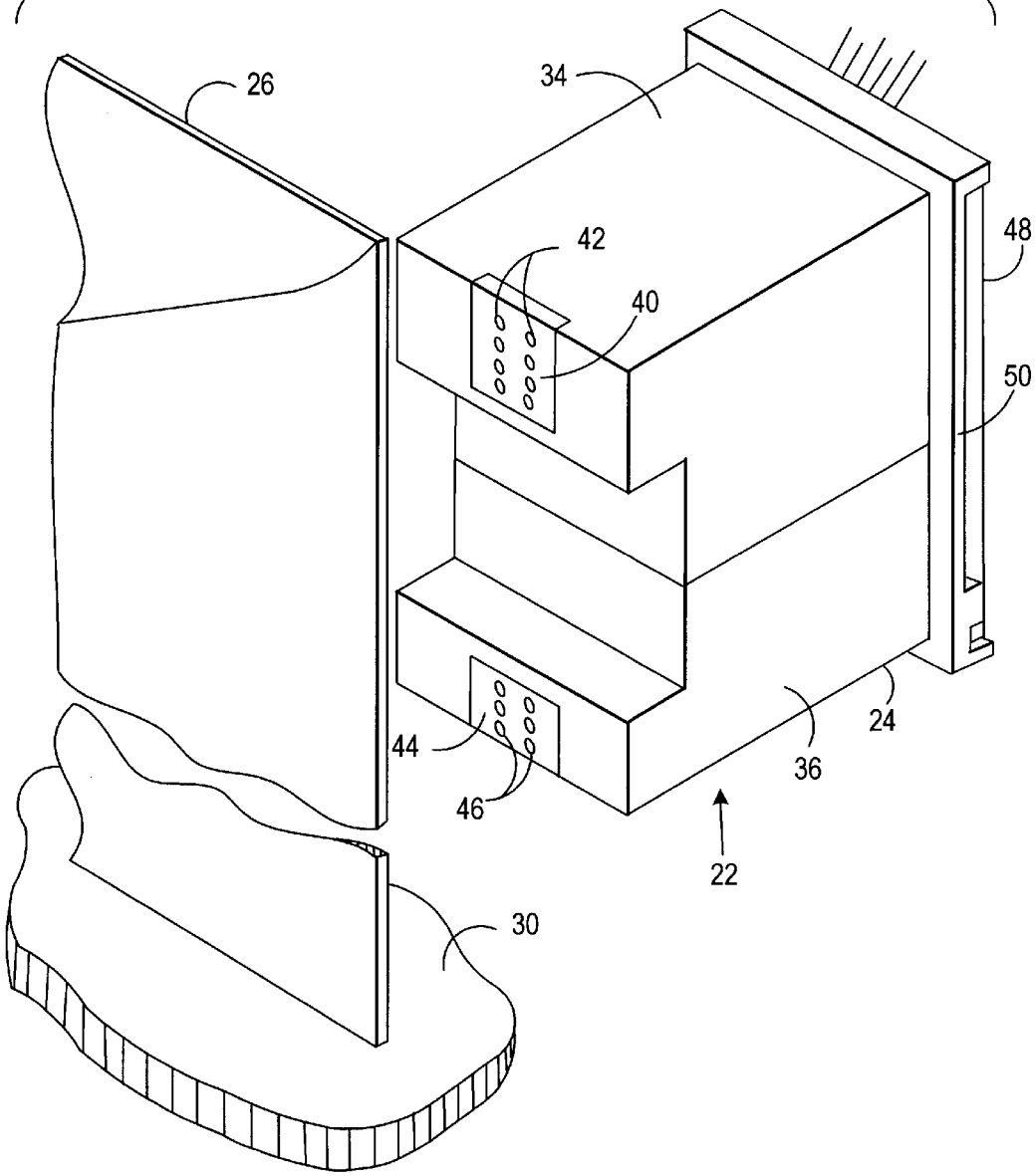
FIG. 2 is an expanded perspective view of an ink jet printer which utilizes the instant invention.

With reference now to FIG. 2, in one embodiment of the invention, the printer 22 can be an ink jet printer and mail pieces 26 can be transported on a deck 30 past the printer with the flap 28 of the envelope located on the opposite side from the printer. The printer 22 has two chambers 34, 36 for receiving two different types of inks. Ink jet printers of this type are commercially available from companies such as Spectra Inc. of Hanover, N.H., which markets a hot melt ink jet printer and Hewlett Packard Ink Jet Printer Model 550C, which is a bubble jet printer having multiple channels whereby different colors can be printed simultaneously.

A first printhead 40 having two rows of nozzles 42 is located in the upper portion of the printer 22 and a second printhead 44 also having two rows of nozzles 46 is located at the bottom portion of the printer, both printheads being in a position to address the upper right corner of the mail piece 26. The first chamber 34 can receive a first ink such as a fluorescent ink and the second chamber 36 can receive a second ink such as black ink. Such inks are well known and will not be described. A plastic cap 48 is receivable within a holder 50 for the purpose of holding the inks within the chambers 34, 36.

The printer 22 communicates with the matrix character generator 20 to be controlled thereby. Under control of the matrix character generator 20, the nozzles 42, 46 will selectively discharge ink droplets from their respective chambers 34, 36 so as to print in accordance with the instructions from the matrix character generator.

Figure 3:
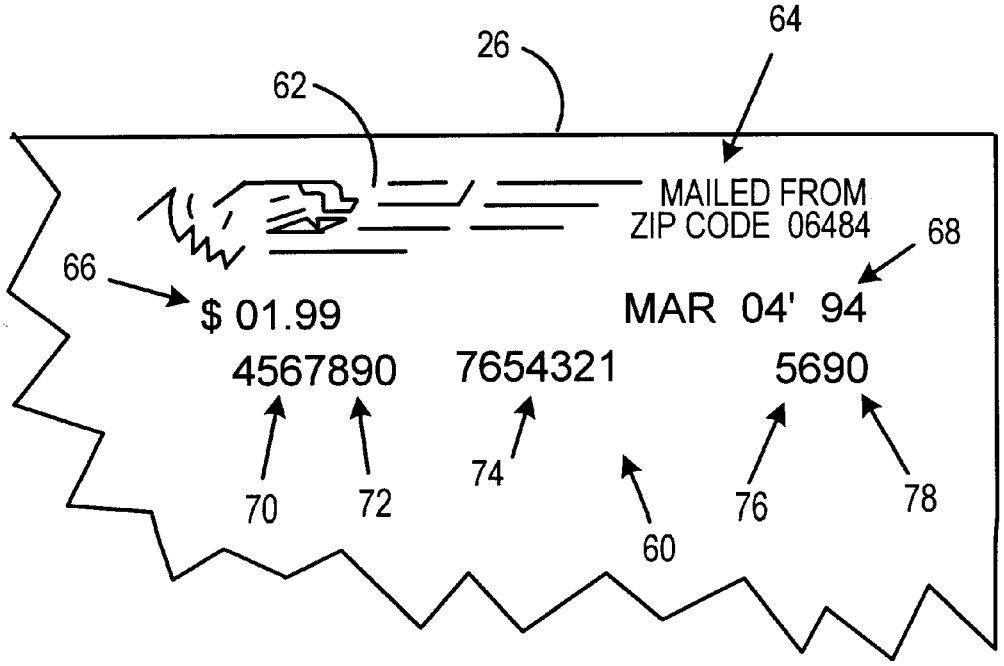
FIG. 3 is a perspective view of a thermal printer that utilizes the instant invention.

With reference now to FIG. 3, an example of an imprint indicia 60 formed in accordance within the instant invention is given. A logo is shown at 62 and is defined by thin lines to indicate a first color, in this case the color being fluorescent red. In addition, the zip code from which the mail originated is also printed with fluorescent ink in an area 64 adjacent to the logo. Below the logo 62 and zip code 64, the postage amount 66 is printed and is shown formed by bold letters to indicate a second color, in this case, the color being black. Below the zip code designation 64 is a printing of the date 68 in black ink. A verification line 70 is printed which includes the postage meter number 72, the customer identification number 74, the number of the mail piece 76 for a particular run, and an encrypted number 78. The verification line 70 is shown formed by bold letters to indicate a second color. The indicia 60 will have been printed by ink being ejected through the nozzles 42, 46 of printhead 22 as a mail piece 26 is conveyed past the printer 22 and the indicia will be of the size prescribed by the postal service approximately 1.5"×3.0". As stated previously, the chamber 34 contains fluorescent red ink for the printing of the logo 62 and zip code 64 and the chamber 36 contains black ink which is used to print the amount 66, the date 68 and verification line 70.

The number 78 is an encrypted message that is derived from data present in the indicia 60 such as the amount of postage 66, date 68, postage meter number 72, customer identification number 74 and piece number 76, or any combination of some of these elements, all of which can be read by an OCR device. Encryption methods for deriving encryption numbers are well known, see for example U.S. Pat. Nos. 4,853,961 and 5,073,935. With such encryption, the data in the verification line 70 can be read and with the appropriate encryption key the postal service can determine from the encryption number 78 whether the postage indicia 60 is authentic.

Thus what has been shown and described is the use of a single printer that is capable of printing both the postage logo 62 and the OCR readable data 66, 68, 70 on a mail piece, within the area designated by the postal service for the placement of an indicia. With the printer of the instant invention, one not only is capable of reducing the amount of equipment necessary to print information on a mail piece, but one is able to prepare a mail piece with authentication data that can be more rapidly read and deciphered.

Figure 4:
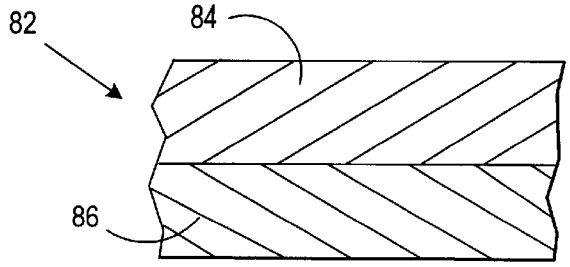
FIG. 4 is a plan view of a thermal ribbon that can be used in the instant invention.

With reference to FIG. 4, a ribbon for a double printer is partially shown at 82 with the upper half 84 having red fluorescent ink and the lower half 86 having black ink. Such thermal transfer ribbons are commercially available as from Olivetti Company, Pelican Corp., Dai Nippon, Chemcraft Int. and other manufacturers. Generally these thermal ribbons are made from a material such as mylar with a wax base or a polymeric base having a dye/pigment thereon.

The above embodiments have been given by way of illustration only, and other embodiments of the instant invention will be apparent to those skilled to in the art from consideration of the detailed description. Accordingly, limitations on the instant invention are to be found only in the Claims.

What is claimed is:

1. A postage meter having a housing, a keypad supported by the housing, a microprocessor 16 supported within the housing and in connection with a keypad, a matrix character generator, in communication with the microprocessor, a meter memory unit in communication with a microprocessor and a printer supported by said housing and in connection with said matrix character generator for printing a postage indicia, said printer comprising:

a) a housing, first and second printheads of an ink jet printer spaced from one another and supported by said housing, each of said printheads having a plurality of elements located within the area defined by a postage indicia; wherein said microprocessor includes means for controlling said first printhead for printing a postage indicia logo and said second printhead to print optical character recognition readable information both within the indicia area;

b) a red fluorescent ink in confluence with said first printhead;

c) a black ink in communication with said second printhead, and means causing said first and second printheads to applying therein respective inks directly to a mail piece to form a mail indicia, that contains fixed and variable information.

2. The postage meter of claim 1 wherein said microprocessor includes means for controlling said printer to print an encrypted message from postage data located within said postage indicia.

3. The postage meter claimed in claim 1, wherein said first and second inks are applied at the same time.

4. The postage meter of claim 1, wherein said second printhead prints optical character recognition readable information in the form of alpha numeric characters.

5. The postage meter of claim 1, wherein said second printhead prints optical character recognition readable information in the form of a bar code.

6. A postage meter having a housing, a keypad supported by the housing, a microprocessor supported within the housing and in connection with the keypad, a matrix character generator in connection with the microprocessor, a meter memory unit in connection with the microprocessor and a printer supported by said housing and in connection with said matrix character generator for printing a postage indicia, said printer comprising:

a) a printer housing, first and second printheads of an ink jet printer supported by said printer housing, each of said printheads having a plurality of print elements;

b) a first ink chamber confluent with said first printhead and a second ink chamber confluent with said second printhead; wherein said microprocessor causes said first printhead to print a postage logo and causes said second printhead to print optical character recognition readable information, both said logo and said information being located within the space for a postal meter indicia;

c) a first ink received in said first chamber, d) second ink received in said second chamber; and e) means for ejecting ink from said print element directly to the area of a postage meter indicia on a mail piece that contains fixed and variable information.

7. The postage meter of claim 6 wherein said first chamber has red fluorescent ink therein and said second chamber has black ink therein.

8. The postage meter claimed in claim 6, wherein said first and second inks are ejected at the same time.

* * * * *